US007302202B2

(12) United States Patent
Tai et al.

(10) Patent No.: US 7,302,202 B2
(45) Date of Patent: Nov. 27, 2007

(54) COOLING SYSTEM AND IMAGE FORMING APPARATUS WITH COOLING SYSTEM

(75) Inventors: Shinichi Tai, Ebina (JP); Shinichiro Taga, Ebina (JP); Masao Watanabe, Ashigarakami-gun (JP); Seigo Makida, Ebina (JP); Kenta Ogata, Ebina (JP); Koji Morofuji, Ebina (JP); Hiroyuki Funo, Ashigarakami-gun (JP); Kiyoshi Iida, Ashigarakami-gun (JP); Ryota Mizutani, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 196 days.

(21) Appl. No.: 11/172,877

(22) Filed: Jul. 5, 2005

(65) Prior Publication Data

US 2006/0204271 A1 Sep. 14, 2006

(30) Foreign Application Priority Data

Mar. 10, 2005 (JP) ..... 2005-067914

(51) Int. Cl.
*G03G 21/20* (2006.01)

(52) U.S. Cl. ..... 399/92

(58) Field of Classification Search ..... 399/91, 399/92, 94, 97, 44; 73/702, 703
See application file for complete search history.

(56) References Cited

U.S. PATENT DOCUMENTS 5,787,321 A * 7/1998 Nishikawa et al. ..... 399/69
5,971,597 A * 10/1999 Baldwin et al. ..... 700/277
7,100,452 B2 * 9/2006 Marsh ..... 73/703

FOREIGN PATENT DOCUMENTS

JP 2-81076 A 3/1990
JP 3-311863 A 12/1990
JP 3-63674 A 3/1991
JP 11-272147 A 10/1999

* cited by examiner

*Primary Examiner*—Hoang Ngo
(74) *Attorney, Agent, or Firm*—Oliff & Berridge, PLC

(57) ABSTRACT

The present invention provides a cooling system including: a cold air generator which supplies cold air into a case of an apparatus; a wireless temperature sensor which is provided near at least one module constituting the apparatus and sends temperature data as a radio signal; a transmitter/receiver which sends a radio signal having a predetermined frequency to the temperature sensor and receives a radio signal from the temperature sensor; and a controller which controls an operation of the cold air generator on the basis of a radio signal received by the transmitter/receiver.

8 Claims, 5 Drawing Sheets

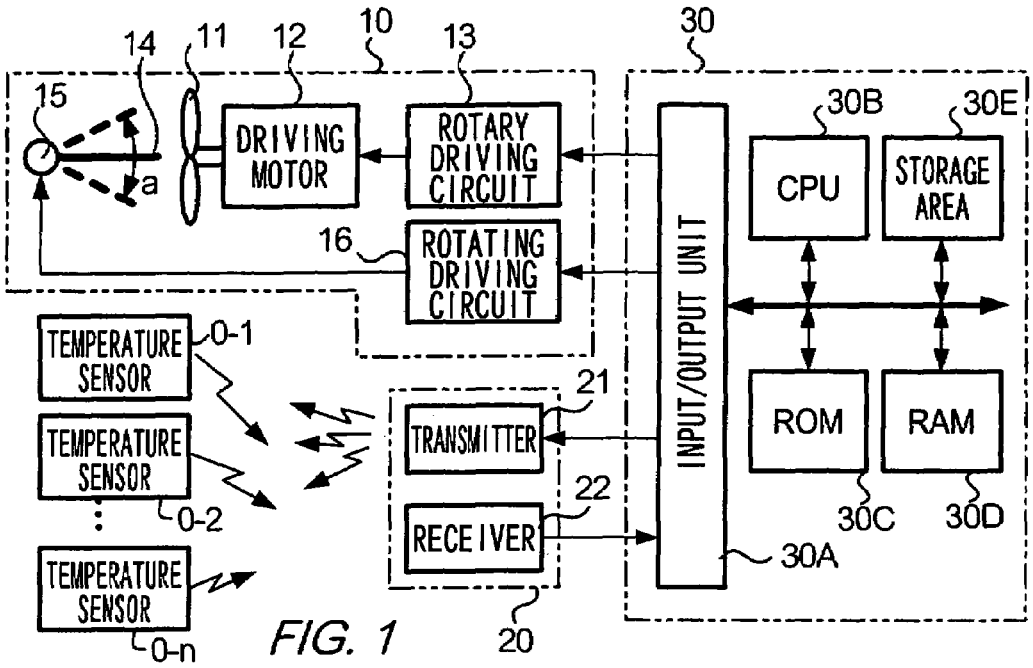
FIG. 1
FIG. 2A
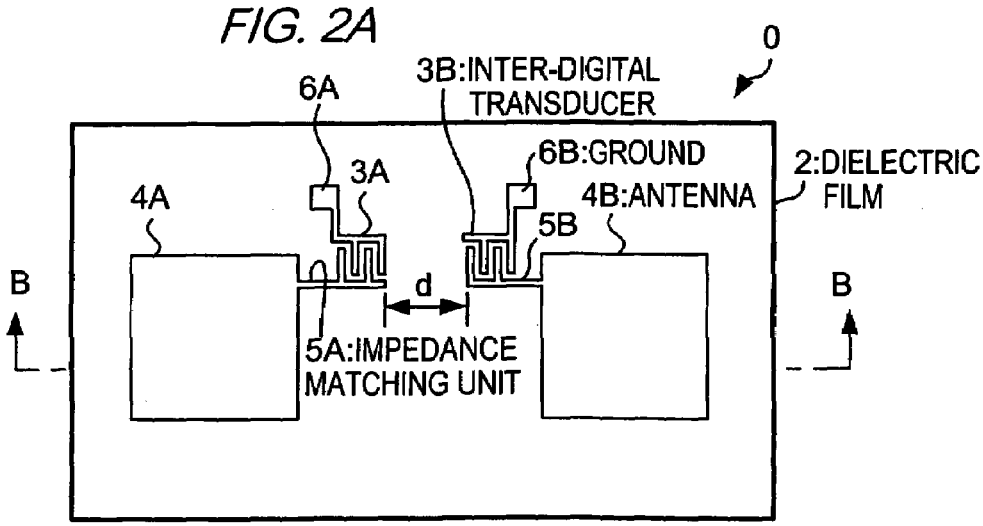
FIG. 2B
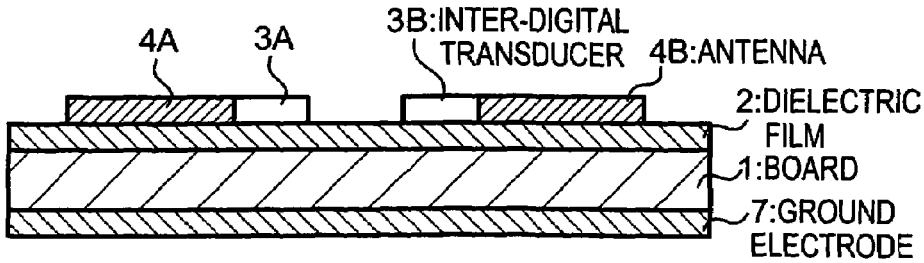

COOLING SYSTEM AND IMAGE FORMING APPARATUS WITH COOLING SYSTEM

This application claims priority under 35 U.S.C. §119 of Japanese Patent Applications No. 2005-67914 filed on Mar. 10, 2005, the entire content of which is hereby incorporated by reference.

BACKGROUND OF THE INVENTION

1. Field of the Invention

The present invention relates to a cooling system suitable for an apparatus with a module which needs cooling such as a copier or a printer.

2. Description of the Related Art

An image forming apparatus includes a module which needs cooling, the apparatus being provided with a cooling fan for controlling temperature rise of a module, such as a fuser; a photoreceptor; a toner housing unit; and a developing unit. The image forming apparatus is also provided with a temperature sensor therein, and a controller of the image forming apparatus, on the basis of a measurement result of the temperature sensor, controls the start/stop function and the rotational speed of the cooling fan, namely the quantity of cold air required for cooling a module. Such a technique is disclosed in Japanese Patent Application Laid-open Publication No. H02-81076, No. H02-311863, No. H03-63674, and No. H11-272147.

To cool each module effectively it is necessary to provide each module with a separate temperature sensor as the temperature of each module may vary significantly. Further, each temperature sensor needs to be connected to a controller with a lead wire. In the above related arts, a temperature sensor and a controller are connected with a lead wire. However, since a contact failure can occur in a connector connecting each lead wire, and since a lead wire near a high-temperature module tends to deteriorate with time and consequently electrical resistance thereof increases, the measurement accuracy of a temperature sensor can be reduced.

Further, if a module is a replaceable one, each time the module is replaced, a temperature sensor of the module side and a lead wire of an apparatus side need to be connected with a connecter, and which operation can be cumbersome.

The present invention has been made with a view to addressing the problem discussed above, and provides a technique which enables a cooling system to take accurate temperature measurements over a long duration of time and which system does not require connector joints; and an image forming apparatus with the cooling system.

SUMMARY OF THE INVENTION

To address the problems discussed above, the present invention provides a cooling system including: a cold air generator which supplies cold air into a case of an apparatus; a wireless temperature sensor which is provided near at least one module constituting the apparatus and sends temperature data as a radio signal; a transmitter/receiver which sends a radio signal having a predetermined frequency to the temperature sensor and receives a radio signal from the temperature sensor; and a controller which controls an operation of the cold air generator on the basis of a radio signal received by the transmitter/receiver.

According to a cooling system of the present invention, by controlling an operation of a cold air generator on the basis of temperature measurement results of wireless temperature measuring devices provided to each module, the quantity and the wind direction of cold air are adjusted, and consequently each module can be cooled effectively.

Further, the wireless temperature measuring devices need not be connected With a lead wire. Accordingly, a contact failure and an increase in electrical resistance of a lead wire can be avoided, and consequently it would be possible to take accurate temperature measurements over a longer duration of time.

BRIEF DESCRIPTION OF THE DRAWINGS

Embodiments of the present invention will be described in detail with reference to the following figures, wherein:

FIG. 1 is a block diagram illustrating a configuration of a cooling system according to an embodiment of the present invention;

FIGS. 2A and 2B are diagrams illustrating a configuration of a wireless temperature sensor according to the embodiment;

DETAILED DESCRIPTION OF THE INVENTION

Figure 3:
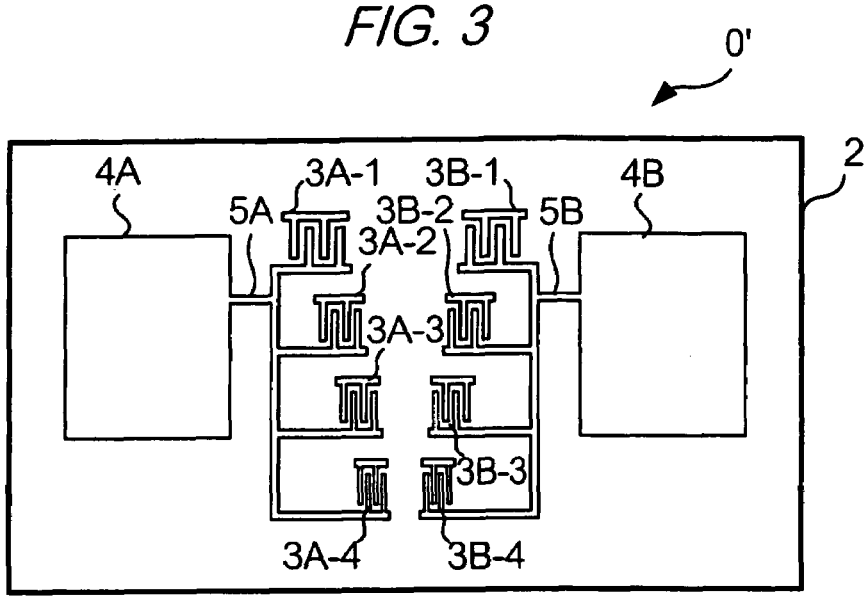
FIG. 3 is a diagram illustrating another configuration of a wireless temperature sensor according to the embodiment.

Embodiments of the present invention will be described with reference to the drawings.

1. Configuration of Cooling System

A configuration of a cooling system according to the present invention will be described with reference to FIG. 1.

The cooling system includes: cold air generator 10 which generates cold air; wireless temperature sensor 0-1, 0-2, . . . 0-n (hereinafter referred to as "temperature sensor 0", except where it is necessary to specify otherwise) attached near each module; transmitter/receiver 20 which exchanges radio signals with temperature sensor 0-1 to 0-n; and controller 30 which controls on the basis of a signal received by transmitter/receiver 20, an operation of cold air generator 10.

Cold air generator 10 includes cooling fan 11, which generates cold air when driving motor 12 and is run by rotary driving circuit 13 in response to a driving signal from controller 30. Further, cold air generator 10 is provided with a louver 14 which is fitted in the direction of the cold air supplied by cooling fan 11, so that one edge of louver 14 is rotatably supported by wind direction adjusting motor 15 and the opposite edge extends toward cooling fan 11. Louver 14 rotates in the direction of arrow when wind direction adjusting motor 15 is run by rotating driving motor 16 in response to a wind direction adjusting signal received from controller 30. Cold air generator 10 may be also provided with, in addition to louver 14, another louver arranged parallel to or substantially parallel to louver 14.

Controller 30 includes: input/output unit 30A such as an interface; CPU (Central Processing Unit) 30B; ROM (Read Only Memory) 30C; RAM (Random Access Memory) 30D; and storage area 30E, etc. ROM 30C stores, in addition to programs for controlling an apparatus equipped with the cooling system, programs for a BPF (Band Pass Filter) function of extracting predetermined frequencies f1 to f4 for recognizing plural temperature sensors 0, and for a calculating function of converting the amount of change of a frequency to a temperature. ROM 30C also stores programs for a cooling control process of FIG. 4, for a temperature measuring process of FIG. 5, and for a cold air control process. RAM 30D is used as a work area by CPU 30B when executing the programs. Storage area 30E stores a table (or a conversion formula) for converting the amount of change of a frequency to a temperature, and a predetermined temperature for each module. The predetermined temperature is a cooling temperature required by each module.

2. Wireless Temperature Sensor 2-1. Basic Configuration of Temperature Sensor

A basic configuration of wireless temperature sensor 0 according to the present embodiment will be described.

Wireless temperature sensor 0 includes: as shown in FIGS. 2A and 2B, board 1 which is a base; dielectric film 2 which is formed on board 1 and on which a surface acoustic wave propagates; a pair of inter-digital transducers 3A and 3B which convert an electrical signal to a surface acoustic wave, or vice versa; antennas 4A and 4B which are connected to an end of inter-digital transducers 3A and 3B via impedance matching units 5A and 5B respectively, and exchanges a radio signal with an external transmitter/receiver; grounds 6A and 6B which are connected to another end of inter-digital transducers 3A and 3B, respectively; and ground electrode 7 which is formed on the underside surface of board 1 and connected with grounds 6A and 6B via through holes.

The frequency of a surface acoustic wave of temperature sensor 0 depends on the shapes of inter-digital transducers 3A and 3B and impedance matching units 5A and 5B. Generally, the frequency of a surface acoustic wave which is generated on dielectric film 2, ranges from 400 MHz to 800 MHz.

2-2. Material of Temperature Sensor

Materials of components constituting temperature sensor 0 will be described.

Dielectric film 2 is made of $LiNbO_3$. In a crystal of $LiNbO_3$, the propagation velocity of its surface acoustic wave is responsive to a temperature change, and a change of the propagation velocity due to a temperature change causes the frequency of a surface. acoustic wave to change. The temperature coefficient is approximately $75\times10^{-6}/°$ C. An experiment shows, as an example, that when the temperature of a crystal of $LiNbO_3$ changes by 100° C., the frequency of a surface acoustic wave changes from center frequency f0 by 0.2% to 0.3%.

Inter-digital transducers 3A and 3B, antennas 4A and 4B, impedance matching units 5A and 5B, and grounds 6A and 6B are formed integrally as a conductive pattern. A material of the conductive pattern may be a metal such as Ti, Cr, Cu, W, Ni, Ta, Ga, In, Al, Pb, Pt, Au, and Ag, and an alloy such as Ti—Al, Al—Cu, Ti—N, and Ni—Cr. In the metals, especially Au, Ti, W, Al, and Cu are preferable. The conductive pattern may have a single layer or multilayer structure of the metal or alloy. The thickness of the metal layer preferably ranges from 1 nanometer to under 10 micrometers.

2-3. Measurement Operation of Temperature Sensor

A basic measurement operation of temperature sensor 0 will be described. For clarity of explanation, it is assumed in the following description that a signal in FIG. 2A travels from antenna 4A to antenna 4B. However, the signal may travel from antenna 4B to antenna 4A.

Temperature sensor 0 exchanges a radio signal with transmitter 21 or receiver 22 of transmitter/receiver 20. A radio signal sent from transmitter 21 is received by antenna 4A, and inter-digital transducer 3A, in response to the radio signal, excites dielectric film 2 to generate a mechanical vibration. The mechanical vibration causes a surface acoustic wave on dielectric film 2. The surface acoustic wave is propagated from inter-digital transducer 3A toward inter-digital transducer 3B, during which the surface acoustic wave varies in response to a change in the temperature surrounding dielectric film 2 in terms of the attributes of the surface acoustic wave such as amplitude, phase difference, and frequency, etc. The surface acoustic wave which has reached inter-digital transducer 3B is converted by inter-digital transducer 3B to an electrical signal and sent via antenna 4B. The radio signal sent from temperature sensor 0 is received by receiver 22.

Receiver 22 which has received the radio signal converts the radio signal to an electrical signal and sends the electrical signal to controller 30. Controller 30 analyzes the electrical signal and thereby calculates the temperature detected by temperature sensor 0.

2-4. Support for Plural Temperature Sensors

In the foregoing sections 2-1 to 2-3, a temperature sensor tunable for one frequency is described. Now, a wireless temperature sensor tunable for plural frequencies will be described.

As shown in FIG. 3, in temperature sensor 0', inter-digital transducers 3A-1 to 3A-4 and 3B-1 to 3B-4 are provided, which are different to each other in shape. In temperature sensor 0', surface acoustic waves corresponding to plural frequencies for which inter-digital transducers 3A-1 to 3A-4 and 3B-1 to 3B-4 can be tuned are generated on dielectric film 2.

For example, it is assumed that inter-digital transducers 3A-1 and 3B-1 and impedance matching units 5A and 5B are tunable for frequency f1, inter-digital transducers 3A-2 and 3B-2 and impedance matching units 5A and 5B are tunable for frequency f2, inter-digital transducers 3A-3 and 3B-3 and impedance matching units 5A and 5B are tunable for frequency f3, and inter-digital transducers 3A-4 and 3B-4 and impedance matching units 5A and 5B are tunable for frequency f4.

Please note that in FIG. 3, grounds and a ground electrode are omitted.

If a radio signal having frequency f1 is sent from transmitter 21, inter-digital transducer 3A-1 generates a mechanical vibration, which causes a surface acoustic wave on dielectric film 2. The surface acoustic wave is propagated to inter-digital transducer 3B-1, during which the attribute of the surface acoustic wave changes under the influence of the surrounding temperature.

On the other hand, in the other inter-digital transducers 3A-2 to 3A-4 and 3B-2 to 3B-4, generation of a surface acoustic wave and subsequent transmission of a radio signal are not performed, because they are not tuned for frequency f1.

If a radio signal having frequency f2 is sent to temperature sensor 0, a surface acoustic wave is propagated from inter-digital transducer 3A-2 to inter-digital transducer 3B-2, and a radio signal corresponding to the surface acoustic wave is sent via antenna 4B.

If a radio signal having frequency f3 is sent to temperature sensor 0, a surface acoustic wave is propagated from inter-digital transducer 3A-3 to inter-digital transducer 3B-3, and a radio signal corresponding to the surface acoustic wave is sent via antenna 4B.

If a radio signal having frequency f4 is sent to temperature sensor 0, a surface acoustic wave is propagated from inter-digital transducer 3A-4 to inter-digital transducer 3B-4, and a radio signal corresponding to the surface acoustic wave is sent via antenna 4B.

Accordingly, if four radio signals which have frequencies f1, f2, f3, and f4 respectively are sent to temperature sensor 0 in order, receiver 22 of transmitter/receiver 20 receives signals corresponding to the frequencies in that order.

In this case, if the variation widths (the width of a change due to a temperature change) of the frequency of a radio signal sent from inter-digital transducers 3B-1 to 3B-4 (output side) are set so that they do not overlap with each other, even if the four radio signals having frequencies f1 to f4 respectively are sent to temperature sensor 0 simultaneously, CPU 30B of controller 30 can separate and analyze the four signals received in response.

For example, it is assumed that four temperature sensors 0-1 to 0-4 are attached to measuring objects a to d, respectively. Specifically, in temperature sensor 0-1, inter-digital transducers 3A-1 and 3B-1 of temperature sensor 0' (see FIG. 3) are formed; in temperature sensor 0-2, inter-digital transducers 3A-2 and 3B-2 of temperature sensor 0' are formed; in temperature sensor 0-3, inter-digital transducers 3A-3 and 3B-3 of temperature sensor 0' are formed; and in temperature sensor 0-4, inter-digital transducers 3A-4 and 3B-4 are formed. Accordingly, the frequency of a surface acoustic wave generated on dielectric film 2 of each temperature sensor is f1, f2, f3, and f4, respectively. Accordingly, on the basis of the frequency of a received radio signal, CPU 30B of controller 30 can determine which of the temperature sensors 0-1 to 0-4 is the source of the radio signal.

Accordingly, if a radio signal having frequency f1 is sent, a temperature measurement is performed by temperature sensor 0-1 a attached to measuring object a; if a radio signal having frequency f2 is sent, a temperature measurement is performed by temperature sensor 0-2 attached to measuring object b; if a radio signal having frequency f3 is sent, a temperature measurement is performed by temperature sensor 0-3 a attached to measuring object c; and if a radio signal having frequency f4 is sent, a temperature measurement is performed by temperature sensor 0-4 a attached to measuring object d.

3. Operation of Cooling System

An operation of a cooling system according to the present embodiment will be described with reference to FIGS. 1, 4 to 6.

In the cooling system, a radio signal is sent from wireless temperature sensor 0 attached near each module to controller 30, and controller 30, on the basis of the radio signal, controls cold air generator 10 to effectively cool each module by cold air.

Figure 4:
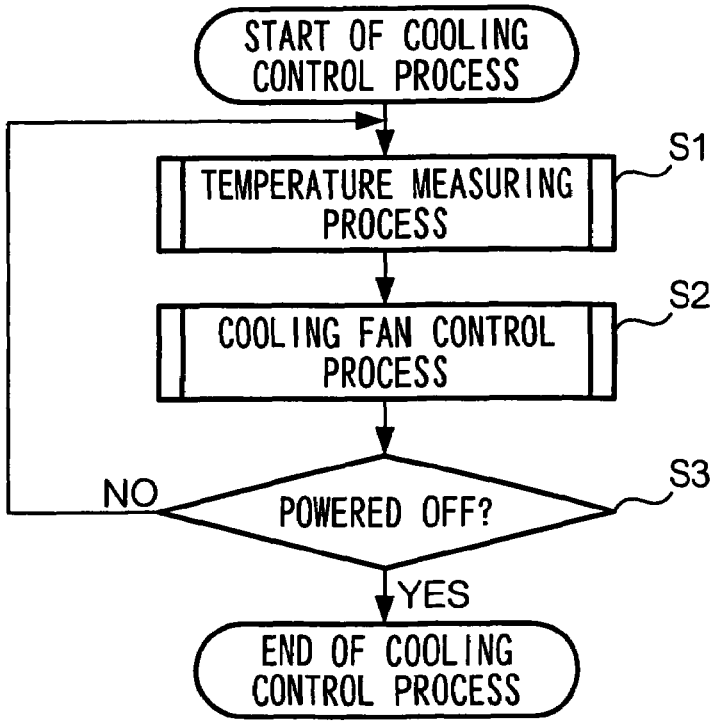
FIG. 4 is a flowchart illustrating a cooling control process according to the embodiment.

As shown in FIG. 4, CPU 30B of controller 30, when an apparatus equipped with the cooling system is powered on, starts execution of a cooling control process of a main routine. Specifically, CPU 30B executes a temperature measuring process of FIG. 5 of a subroutine (Step S1) and a cold air control process of FIG. 6 of a subroutine (Step S2), and until the apparatus is powered off (Step S3; YES), repeats the processes.

Figure 5:
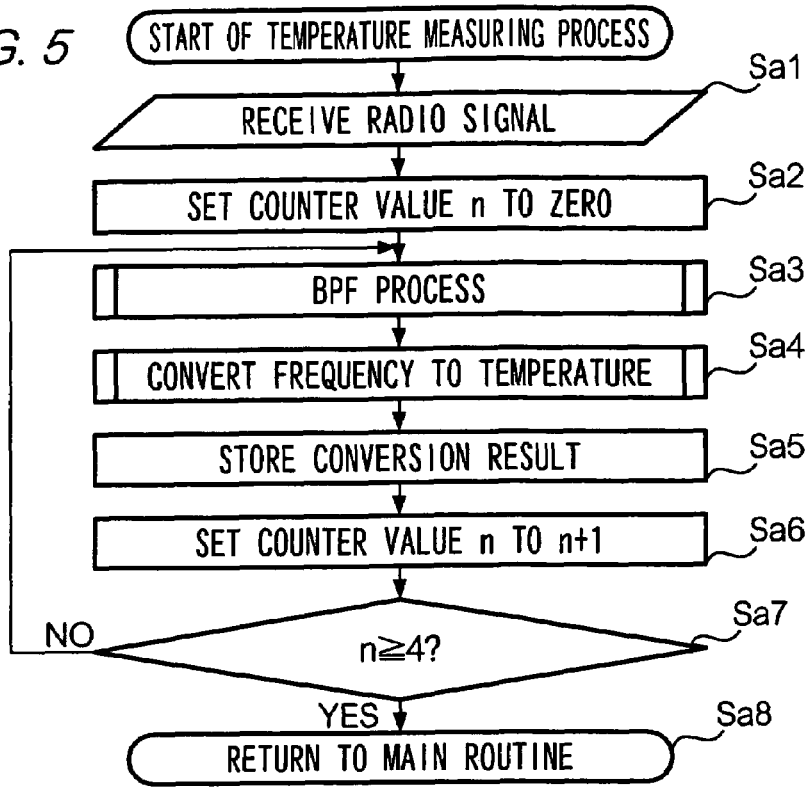
FIG. 5 is a flowchart illustrating a temperature measuring process according to the embodiment.

Now, a temperature measuring process with plural temperature sensors 0, carried out as subroutine of the cooling control process, will be described with reference to FIG. 5.

In the following description, it is assumed that receiver 22 of transmitter/receiver 20 receives radio signals from four temperature sensors 0-1 to 0-4. There may be many more than four or fewer temperature sensors, as long as each temperature sensor 0 can be identified by the frequency of a radio signal sent therefrom.

First, CPU 30B of controller 30 receives radio signals wherein four frequencies from temperature sensors 0-1 to 0-4 are mixed (Step Sa1).

CPU 30B sets value n of a counter (not shown) to "0" (Step Sa2).

CPU 30B performs a BPF process to extract frequency f1 (Step Sa3), and calculates a temperature detected by temperature sensor 0-1 on the basis of a table pre-stored in storage area 30E (Step Sa4). CPU 30B subsequently stores the calculated temperature in RAM 30D (Step Sa5).

CPU 30B increments the counter from n to n+1 (Step Sa6), and determines whether the incremented value has become equal to or more than "4" (Step Sa7). When it is determined that the incremented value is less than "4", namely all temperatures detected by four temperature sensors 0 have not been calculated, CPU 30B repeats the operation of Step Sa3 and the subsequent operations. When it is determined that the incremented value has reached "4", namely all temperatures detected by four temperature sensors 0 have been calculated, CPU 30B returns to the main routine (Step Sa8).

As described above, CPU 30B, by identifying temperature sensor 0 by the frequency of a radio signal sent from temperature sensor 0, can obtain measurement results from plural temperature sensors 0, and store the measurement results in RAM 30D sequentially.

Now, a cold air control process which operates as subroutine of the cooling control process will be described with reference to FIG. 6.

CPU 30B reads from RAM 30D a temperature detected near each module stored in the temperature measuring process (Step Sb1), and determines whether the temperature exceeds a predetermined temperature set for each module (Step Sb2). The determination is performed for all modules, and if it is determined that the temperatures of all the modules are equal to or less than their predetermined temperatures (Step Sb2; NO), CPU 30B sends to rotary driving circuit 13 a driving signal to stop driving motor 12. In response to the driving signal, rotary driving circuit 13 stops driving motor 12 (Step Sb3). Consequently, rotation of cooling fan 11 stops, and a flow of cold air into the apparatus stops.

If it is determined that any one of the temperatures of all the modules are more than their predetermined temperatures (Step Sb2; YES), CPU 30B sends to rotary driving circuit 13 a driving signal to start driving motor 12 (Step Sb4). In response to the driving signal, rotary driving circuit 13 starts driving motor 12, and cold air is supplied from cooling fan 11. However, the wind direction of the cold air has not been controlled at the present time therefore a module which needs cooling most may not have been cooled appropriately.

Accordingly, CPU 30B compares a temperature detected near each module with a predetermined temperature set for each module, and thereby selects a module which needs cooling most (Step Sb5). Specifically, CPU 30B identifies, among the temperatures which exceed their predetermined temperatures, a temperature which differs most from its predetermined temperature, and selects a module corresponding to the identified temperature as a module which needs cooling most.

After selecting a module which needs cooling most, CPU 30B sends to rotating driving circuit 16 a wind direction adjusting signal to control wind direction adjusting motor 15 so that cold air is sent to the module (Step Sb6), and returns to the main routine (Step Sb7).

Consequently, wind direction adjusting motor 15 rotates louver 14 accordingly, and thereby cold air from cooling fan 11 is supplied to the module which needs cooling most.

CPU 30B repeats the main routine described thus far and adjusts the wind direction of cold air by louver 14 accordingly so that the cold air is sent to a module which needs cooling most. As a result, it becomes possible to cool each module effectively.

4. Effect of Cooling System

According to a cooling system of the present embodiment, since a wireless temperature sensor is used, a hitherto needed lead wire connecting a temperature sensor with a controller is unnecessary. Consequently, carrying out wiring and a connector connecting each lead wire also become unnecessary. Accordingly, a contact failure and increase in electrical resistance of a lead wire can be avoided, and consequently accurate temperature measurements over a long duration become possible.

5. Application Example

An application example of the cooling system discussed above will be described with reference to FIG. 7.

5-1. Configuration of Image Forming Apparatus 100

Figure 7:
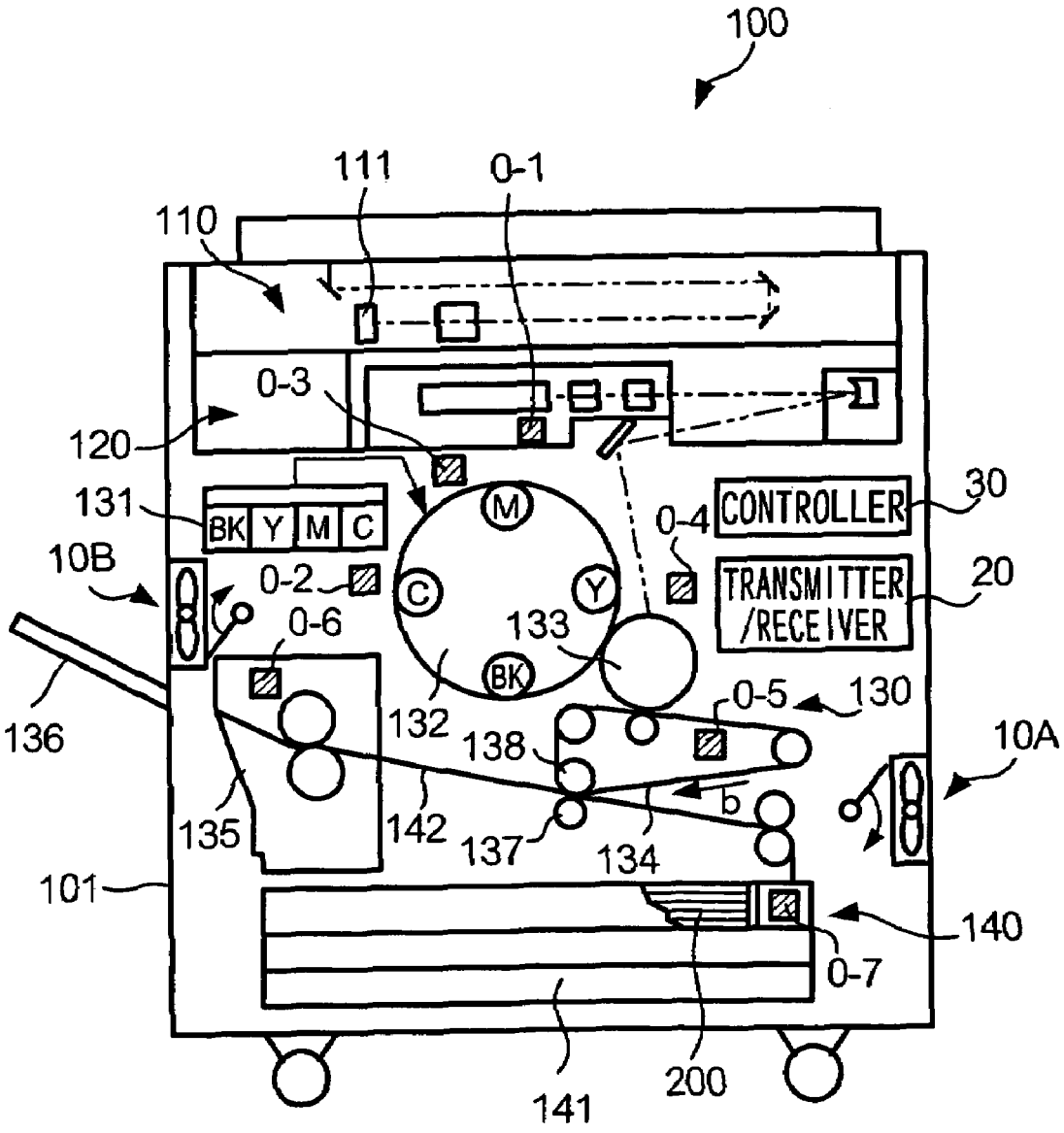
FIG. 7 is a diagram illustrating a configuration of an image forming apparatus with a cooling system according to the embodiment.

FIG. 7 is a diagram illustrating a configuration of image forming apparatus 100. Image forming apparatus 100 is, for example, a color printer, a color copier, or a complex machine equipped with abilities of the former two apparatuses. Image forming apparatus 100 includes in case 101, image input terminal 110, image processing system 120, image output terminal 130, paper feeder 140, and controller 30.

Image processing system 120 temporarily stores image data input by image input terminal 110 or a personal computer (not shown), or image data sent via a telephone line or a LAN, and performs a predetermined image processing to an image of the image data. Controller 30 controls the entire process of image forming apparatus 100, and also controls the cooling system.

Image output terminal 130 performs an image forming on the basis of image data to which the predetermined image processing was performed by image processing system 120. Image output terminal 130 includes: toner cartridge 131 storing toner of yellow (Y), magenta (M), cyan (C), and black (BK); roller-shaped developing unit 132; photosensitive drum 133; intermediate transfer belt 134 (an intermediate belt transfer); and fuser 135.

In image output terminal 130, a toner image transferred onto intermediate transfer belt 134 is transferred onto recording sheet 200 (a recording medium) supplied from paper feed tray 141 of paper feeder 140 along transfer route 142. Subsequently, the toner image is fixed on recording sheet 200 by fuser 135, and recording sheet 200 on which the image was formed is output to paper output tray 136.

Image input terminal 110 causes a light source (not shown) to irradiate a document placed on a platen glass (not shown), and causes image input element 111 such as a CCD sensor to read a light image reflected from the document. Image input element 111 reads the reflected light image in a predetermined dot density (e.g. 16 dots/mm).

The reflected light image read by image input terminal 110 is sent to image processing system 120 as reflectance data of three colors: red (R); green (G); and blue (B) (each of which is 8 bits). Image processing system 120 carries out a predetermined process to the reflection data of the document such as a shading compensation, a displacement correction, a lightness/color space conversion, a gamma correction, an edge erase, a color/displacement editing.

The reflection data of the document to which the predetermined process has been performed by image processing system 120 is converted to tone data (raster data) of four colors: yellow (Y); magenta (M); cyan (C); and black (BK). The tone data of four colors is sent to developing unit 132, and in developing unit 132, a toner image of yellow (Y), magenta (M), cyan (C) and black (BK) is developed.

The toner image of yellow (Y), magenta (M), cyan (C) and black (BK) developed by developing unit 132 is transferred onto intermediate transfer belt 134 via photosensitive drum 133. Intermediate transfer belt 134 runs between rollers under a predetermined tension, and is caused to circulate by a constant-speed driving motor (not shown) in the direction of arrow b at a predetermined speed.

Intermediate transfer belt 134 is, for example, an endless belt made of a flexible synthesis resin film such as polyimide, both ends of which are welded to each other.

The toner image of yellow (Y), magenta (M), cyan (C) and black (BK) which was transferred onto intermediate transfer belt 134 is transferred by secondary transfer roller 138 adjacent to backup roller 137 onto recording sheet 200 with a welding pressure and static electricity, and conveyed to fuser 135 by transfer rollers. Subsequently, recording sheet 200 onto which the toner image was transferred is subject to a fusing process by heat and pressure by fuser 135, and output to paper output tray 136 provided outside of image forming apparatus 100.

The above is the configuration and the operation of image forming apparatus 100.

5-2. Equipping Image Forming Apparatus 100 with Cooling System

When equipping image forming apparatus 100 discussed above with a cooling system, temperature sensors are attached as described below: Temperature sensor 0-1 is attached adjacent to image input terminal 100; temperature sensor 0-2 adjacent to toner cartridge 131; temperature sensor 0-3 is adjacent to developing unit 132; temperature sensor 0-4 adjacent to photosensitive drum 133; temperature sensor 0-5 adjacent to intermediate transfer belt 134; temperature sensor 0-6 adjacent to fuser 135; temperature sensor 0-7 adjacent to paper feed tray 141.

5-3. Operation of Cooling System in Image Forming Apparatus 100

An operation of a cooling system incorporated into image forming apparatus 100 is similar to that of the cooling system described in Section 3. Specifically, the cooling system in image forming apparatus 100 monitors the temperature of each module of the apparatus, and if the temperature of a module exceeds its predetermined temperature, adjusts the tilt of louver 14 of cold air generator 10 so that cold air is sent to the module. Consequently, the module which needs cooling can be cooled effectively by cold air.

In the present application example, it is also possible to configure one cold air generator 10 to take air from outside and generate cold air into case 101, and the other cold air generator 10 to discharge air from within case 101 to outside.

With the configuration, especially in a case where modules in case 101 are located closely to each other, the flow of cold air is created, and consequently the cooling efficiency of the modules is enhanced.

6. Modifications 6-1.

Figure 6:
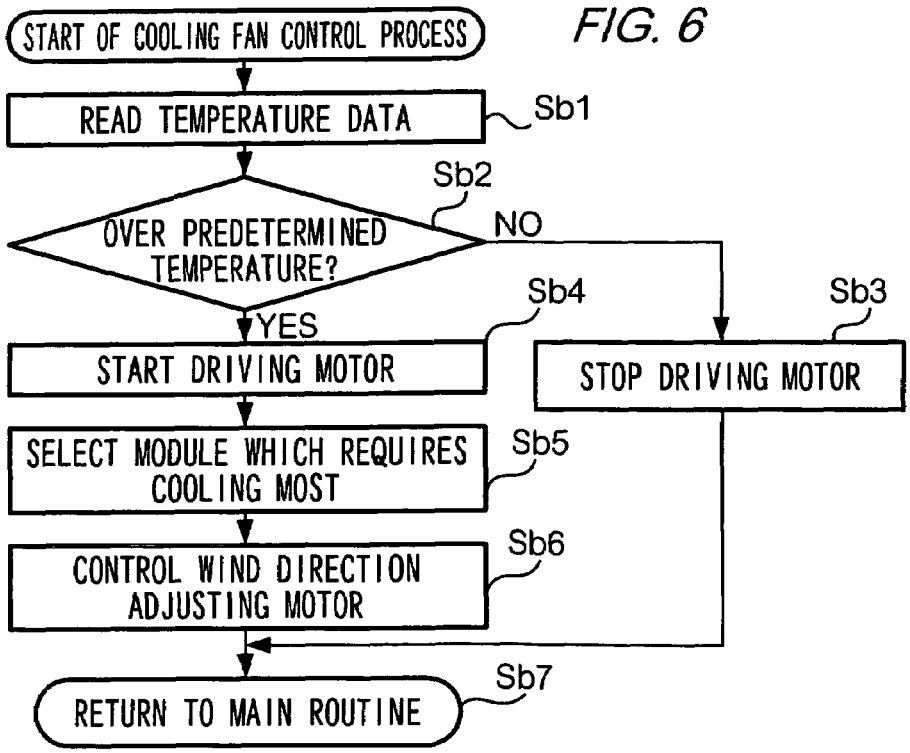
FIG. 6 is a flowchart illustrating a cooling fan control process according to the embodiment.

In the cooling fan control process as shown in FIG. 6, in addition to adjusting the wind direction of cold air, it is also possible to adjust the quantity of cold air in accordance with the rate of change of the temperature of a module.

Figure 8:
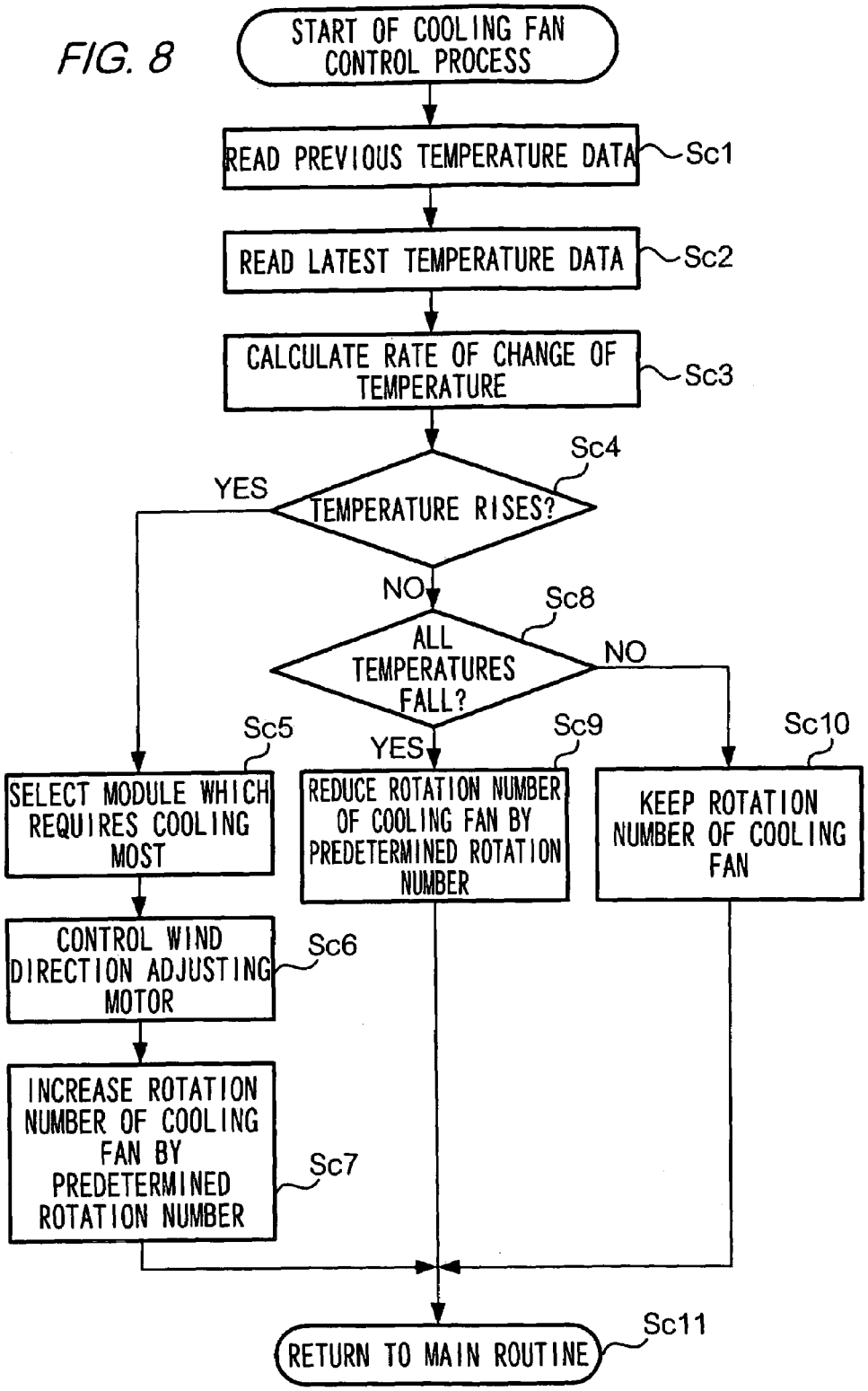
FIG. 8 is a flowchart illustrating a cooling fan control process according to another embodiment.

Specifically, the cooling system operates as shown in FIG. 8.

CPU 30B reads data on temperatures last measured by each temperature sensor 0 (Step Sc1), and also reads data on temperatures measured at the present time by each temperature sensor 0 (Step Sc2). CPU 30B compares, for each temperature sensor 0, temperature data of the last time with temperature data of the present time to calculate the rate of change (Step Sc3). The rate of change shows whether the temperature of a module is on an upward trend, on a downward trend, or remains the same.

CPU 30B determines on the basis of the rate of change of each temperature sensor 0 whether the temperature of any module has risen (Step Sc4). If it is determined that the temperature of any module has risen (Step Sc4; YES), CPU 30B selects on the basis of the rate of change of each temperature sensor 0, a module which needs cooling most (Step Sc5), and causes wind direction adjusting motor 15 to adjust louver 14 so that cold air is sent to the module (Step Sc6). Additionally, CPU 30B sends to rotary driving circuit 13 a driving signal to increase the number of rotations of driving motor 12 by the predetermined number of rotations to increase the quantity of air supplied from cooling fan 11 (Step Sc7). Subsequently, CPU 30B returns to the main routine (Step Sc11).

In summary, a module whose temperature is on an upward trend is selected, and stronger cold air is sent preferentially to the module.

On the other hand, if it is determined that the temperatures of none of the modules have risen (Step Sc4; NO), CPU 30B determines whether the temperatures of all modules have fallen (Step Sc8). If it is determined that the temperatures of all modules have fallen (Step Sc8; YES), to prevent the modules from being excessively cooled, CPU 30B sends to rotary driving circuit 13 a driving signal to decrease the number of rotations of driving motor 12 by the predetermined number of rotations to reduce the quantity of air supplied from cooling fan 11 (Step Sc9). Subsequently, CPU 30B returns to the main routine (Step Sc11).

On the other hand, if it is determined that the temperatures of none of the modules have fallen (Step Sc8; NO), CPU 30B sends to rotary driving circuit 13 a driving signal to keep the current number of rotations of driving motor 12 to keep the current quantity of air supplied from cooling fan 11 (Step Sc0). Subsequently, CPU 30B returns to the main routine (Step Sc11).

As described above, in the present cooling system, by calculating the rate of change of a temperature on the basis of data on temperatures measured by temperature sensor 0, the trend of the temperature of each module is identified, and on the basis of the trend of the temperature, an effective cooling is performed.

6-2.

In the above embodiment, each component of temperature sensor may be made of other materials.

Board 1 of temperature sensor 0 may be made of: an elemental semiconductor such as Si, Ge, and diamond; glass; a III-V series compound semiconductor such as AlAs, AlSb, AlP, GaAs, GaSb, InP, InAs, InSb, AlGaP, AlLnP, AlGaAs, AlInAs, AlAsSb, GaInAs, GaInSb, GaAsSb, and InAsSb; a II-VI series compound semiconductor such as ZnS, ZnSe, ZnTe, CaSe, CdTe, HgSe, HgTe, and CdS; oxide such as Nb-doped or La-doped $SrTiO_3$, Al-doped ZnO, $In_2O_3$, $RuO_2$, $BaPbO_3$, $SrRuO_3$, $YBa_2Cu_2O_{7-x}$, $SrVO_3$, $LaNiO_3$, $La_{0.5}Sr_{0.5}CoO_3$, $ZnGa_2O_4$, $CdGa_2O_4$, $MgTiO_4$, and $MgTi_2O_4$, which are conducting or semiconducting single crystal substrate; and metal such as Pb, Pt, Al, Au, Ag. However, in view of the suitability to an existing semiconductor production process and the production cost, it is preferable to use Si, GaAs, glass as a material of board 1.

Dielectric film 2 may be made of: instead of $LiNbO_3$, oxide such as $SiO_2$, $SrTiO_3$, $BaTiO_3$, $BaZrO_2$, $LaAlO_3$, $ZrO_2$, $Y_2O_3$8%-$ZrO_2$, MGO, $MgAl_2O_4$, $LiTaO_3$, $AlVO_3$, ZnO; a tetragonal system, orthorhombic system, or pseudo-cubic system material such as $BaTiO_3$, $PbTiO_3$, $Pb_{1-x}La_x(Zr_yTi_{1-y})_{1-x/4}O_3$ (PZT, PLT, PLZT depending on the values of X and Y), $Pb(Mg_{1/3}Nb_{2/3})O_3$, $KNbO_3$, which are $ABO_3$-like perovskite-like; a ferroelectric such as $LiNbO_3$ and $LiTaO_3$ which are a pseudo-ilmenite structure; $SrXBa_{1-x}Nb_2O_6$ and $Pb_xBa_xNb_2O_6$ which are tungsten-bronze-like. Dielectric film 2 may also be made of $Bi_4Ti_3O_{12}$, $Pb_2KNb_5O_{15}$, $K_3Li_2Nb_5O_{15}$, and a substitution dielectric of the enumerated ferroelectrics. Dielectric film 2 may be made of $ABO_3$-like perovskite-like oxide including Pb. Especially, among the materials, $LiNbO_3$, $LiTaO_3$, and ZnO are preferable because the change of the surface velocity of their surface acoustic wave and the change of their piezoelectric constant are outstanding. The thickness of dielectric film 2 may be selected in accordance with the intended use; however, generally, it ranges between 1 and 10 micrometers.

Dielectric film 2 may be epitaxial or may have single orientation in view of the electromechanical coupling coefficient/piezoelectric coefficient of inter-digital transducer 3 and of the dielectric loss of antenna 4. Also, on dielectric film 2, a film including a III-V series semiconductor such as GaAs or carbon such as diamond may be formed. As a result, the surface velocity of a surface acoustic wave, the coupling coefficient, and the piezoelectric constant are improved.

6-3.

In the above embodiment, for identifying each temperature sensor 0, instead of differentiating the shape and size of inter-digital transducers 3A and 3B, it is possible to differentiate the distance d (see FIG. 2A) between inter-digital transducers 3A and 3B of each temperature sensor 0 and thereby differentiate the frequency of a surface acoustic wave generated dielectric film 2.

By differentiating the distance between inter-digital transducers 3A and 3B of each temperature sensor 0, the propagation time of a surface acoustic wave generated on dielectric film 2 of each temperature sensor 0 is differentiated. Accordingly, by measuring a time from transmission of a radio signal by transmitter 21 to reception of a radio signal by receiver 22, each temperature sensor 0 is identified.

6-4.

In the above embodiment, in addition to louver 14 which rotates in one direction (up and down), another louver which rotates in a direction perpendicular or substantially perpendicular to the one direction (from side to side) may be provided. With the provision of the other louver, it becomes possible to adjust the wind direction from side to side and up and down.

6-5.

The present invention is applicable to not only an image forming apparatus discussed in the above application example, but also to other apparatuses having a module which needs cooling such as a personal computer and a server.

As described above, the present invention provides a cooling system including: a cold air generator which supplies cold air into a case of an apparatus; a wireless temperature sensor which is provided near at least one module constituting the apparatus and sends temperature data as a radio signal; a transmitter/receiver which sends a radio signal having a predetermined frequency to the temperature sensor and receives a radio signal from the temperature sensor; and a controller which controls an operation of the cold air generator on the basis of a radio signal received by the transmitter/receiver.

According to an embodiment of the invention, the cold air generator may include: a cooling fan which generates the cold air; a motor which rotates the cooling fan; a wind direction adjuster which adjusts a wind direction of the cold air.

According to another embodiment of the invention, the controller may control an operation of the cold air generator to prevent a temperature of the module from exceeding a predetermined temperature.

According to another embodiment of the invention, the controller may control at least one of a start/stop function of cold air generation, a quantity of cold air, and a wind direction of cold air.

According to another embodiment of the invention, the temperature sensor may comprise: an exciter which receives a radio signal from the transmitter/receiver and generates a mechanical vibration; a vibration medium on which a surface acoustic wave is caused by a mechanical vibration generated by the exciter; and a transmitter which converts a surface acoustic wave generated on the vibration medium to an electrical signal and sends it as a radio signal.

The present invention also provides an image forming apparatus including: the cooling system discussed above; and at least one module which is an image input terminal, an image forming unit, a sheet housing unit, or an image output terminal.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, to thereby enable others skilled in the art to understand various embodiments of the invention and various modifications thereof, to suit a particular contemplated use. It is intended that the scope of the invention be defined by the following claims and their equivalents.

What is claimed is:

1. A cooling system comprising:

a cold air generator which supplies cold air into a case of an apparatus;

a plurality of wireless temperature sensors which are provided near at least one module constituting the apparatus and send temperature data as radio signals at different frequencies, wherein the different frequencies correspond to different locations within the apparatus;

a transmitter/receiver which sends radio signals having predetermined frequencies to the temperature sensors and receives radio signals from the temperature sensors; and a controller which controls an operation of the cold air generator on the basis of the radio signals received by the transmitter/receiver.

2. A cooling system according to claim 1, wherein the cold air generator comprises:

a cooling fan which generates cold air;

a motor which rotates the cooling fan;

a wind direction adjuster which adjusts a wind direction of the cold air.

3. A cooling system according to claim 1, wherein the controller controls an operation of the cold air generator to prevent a temperature of the module from exceeding a predetermined temperature.

4. A cooling system according to claim 1, wherein the controller controls at least one of a start/stop function of cold air generation, a quantity of cold air, and a wind direction of cold air.

5. A cooling system according to claim 1, wherein the temperature sensor comprises:

an exciter which receives a radio signal from the transmitter/receiver and generates a mechanical vibration;

a vibration medium on which a surface acoustic wave is caused by a mechanical vibration generated by the exciter; and a transmitter which converts a surface acoustic wave generated on the vibration medium to an electrical signal and sends it as a radio signal.

6. An image forming apparatus comprising:

a cooling system having:

a cold air generator which supplies cold air into a case of an apparatus;

a plurality of wireless temperature sensors which are provided near at least one module constituting the apparatus and send temperature data as radio signals at different frequencies, wherein the different frequencies correspond to different locations within the apparatus;

a transmitter/receiver which sends radio signals having predetermined frequencies to the temperature sensors and receives radio signals from the temperature sensors; and a controller which controls an operation of the cold air generator on the basis of the radio signals received by the transmitter/receiver, the apparatus further comprising:

at least one module which is an image input terminal, an image forming unit, a sheet housing unit, or an image output terminal.

7. A cooling system comprising:

a cold air generator which supplies cold air into a case of an apparatus;

a plurality of wireless temperature sensors which are provided near at least one module constituting the apparatus and send temperature data as radio signals with different delays, wherein the different delays correspond to different locations within the apparatus;

a transmitter/receiver which sends a radio signal having a predetermined frequency to the temperature sensors and receives radio signals from the temperature sensors; and a controller which controls an operation of the cold air generator on the basis of the radio signals received by the transmitter/receiver.

8. An image forming apparatus comprising:

a cooling system according to claim 7; and at least one module which is an image input terminal, an image forming unit, a sheet housing unit, or an image output terminal.

* * * * *